US005540641A

United States Patent [19]

Williams et al.

[11] Patent Number: 5,540,641

[45] Date of Patent: Jul. 30, 1996

[54] DOOR FRAME MOUNTED EXERCISER

[76] Inventors: Harold P. Williams; Lloyd A. Emmerson, both of 2273 Pyle Ct., Santa Clara, Calif. 95051

[21] Appl. No.: 331,994

[22] Filed: Oct. 31, 1994

[51] Int. Cl.[6] ..... A63B 21/015

[52] U.S. Cl. ..... 482/114; 482/115; 482/139; 482/904

[58] Field of Search ..... 482/44–46, 79, 482/114, 115, 117, 139, 148, 904, 60, 908

[56] References Cited

U.S. PATENT DOCUMENTS 618,990 2/1899 Lobben ..... 482/904
1,887,942 11/1932 Mueller ..... 482/115
4,606,541 8/1986 Kirkpatrick ..... 482/139
4,615,335 10/1986 Searcy ..... 482/139
5,407,414 4/1995 Bass ..... 482/904

*Primary Examiner*—Richard J. Apley
*Assistant Examiner*—Jeanne M. Clark

[57] ABSTRACT

A device for exercising the limbs of an individual. The inventive device includes a mounting assembly for securing to the frame of a door. A rotatable arm is coupled to the mounting assembly and is frictionally retarded against rotation thereof relative to the mounting assembly. A limb engaging assembly is mounted to a distal end of the arm, whereby an individual can rotate the arm to exercise the engaging limb.

6 Claims, 4 Drawing Sheets

DOOR FRAME MOUNTED EXERCISER

BACKGROUND OF THE INVENTION

1. Field of the Invention

The present invention relates to exercising devices and more particularly pertains to a door frame mounted exerciser for exercising the limbs of an individual.

2. Description of the Prior Art

The use of exercising devices is known in the prior art. More specifically, exercising devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercising devices include U.S. Pat. No. 3,516,661; U.S. Pat. No. 4,606,541; U.S. Pat. No. 4,858,912; U.S. Pat. No. 3,622,153; U.S. Pat. No. 4,050,693; and U.S. Pat. No. 3,840,227.

While these devices fulfill their respective, particular objectives and requirements, the aforementioned patents do not disclose a door frame mounted exerciser for exercising the limbs of an individual which includes a mounting assembly securable to a door frame, a rotatable arm coupled to the mounting assembly and frictionally retarded against rotation relative thereto, and a limb engaging assembly mounted to a distal end of the arm, whereby an individual can rotate the rotatable arm to exercise the engaging limb.

In these respects, the door frame mounted exerciser according to the present invention substantially departs from the conventional concepts and designs of the prior art, and in so doing provides an apparatus primarily developed for the purpose of exercising the limbs of an individual.

SUMMARY OF THE INVENTION

In view of the foregoing disadvantages inherent in the known types of exercising devices now present in the prior art, the present invention provides a new door frame mounted exerciser construction wherein the same can be utilized for exercising the arms or legs of an individual. As such, the general purpose of the present invention, which will be described subsequently in greater detail, is to provide a new door frame mounted exerciser apparatus and method which has many of the advantages of the exercising devices mentioned heretofore and many novel features that result in a door frame mounted exerciser which is not anticipated, rendered obvious, suggested, or even implied by any of the prior art exercising devices, either alone or in any combination thereof.

To attain this, the present invention generally comprises a device for exercising the limbs of an individual. The inventive device includes a mounting assembly for securing to the frame of a door. A rotatable arm is coupled to the mounting assembly and is frictionally retarded against rotation thereof relative to the mounting assembly. A limb engaging assembly is mounted to a distal end of the arm, whereby an individual can rotate the arm to exercise the engaging limb.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways.

It is therefore an object of the present invention to provide a new door frame mounted exerciser apparatus and method which has many of the advantages of the exercising devices mentioned heretofore and many novel features that result in a door frame mounted exerciser which is not anticipated, rendered obvious, suggested, or even implied by any of the prior art exercising devices, either alone or in any combination thereof.

It is another object of the present invention to provide a new door frame mounted exerciser which may be easily and efficiently manufactured and marketed.

It is a further object of the present invention to provide a new door frame mounted exerciser which is of a durable and reliable construction.

An even further object of the present invention is to provide a new door frame mounted exerciser which is susceptible of a low cost of manufacture with regard to both materials and labor, and which accordingly is then susceptible of low prices of sale to the consuming public, thereby making such door frame mounted exercisers economically available to the buying public.

Still yet another object of the present invention is to provide a new door frame mounted exerciser which provides in the apparatuses and methods of the prior art some of the advantages thereof, while simultaneously overcoming some of the disadvantages normally associated therewith.

Still another object of the present invention is to provide a new door frame mounted exerciser for exercising the limbs, such as the arms and legs, of an individual.

Yet another object of the present invention is to provide a new door frame mounted exerciser which includes a mounting assembly securable to a door frame, a rotatable arm coupled to the mounting assembly and frictionally retarded against rotation relative thereto, and a limb engaging assembly mounted to a distal end of the arm, whereby an individual can rotate the rotatable arm to exercise the engaging limb.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
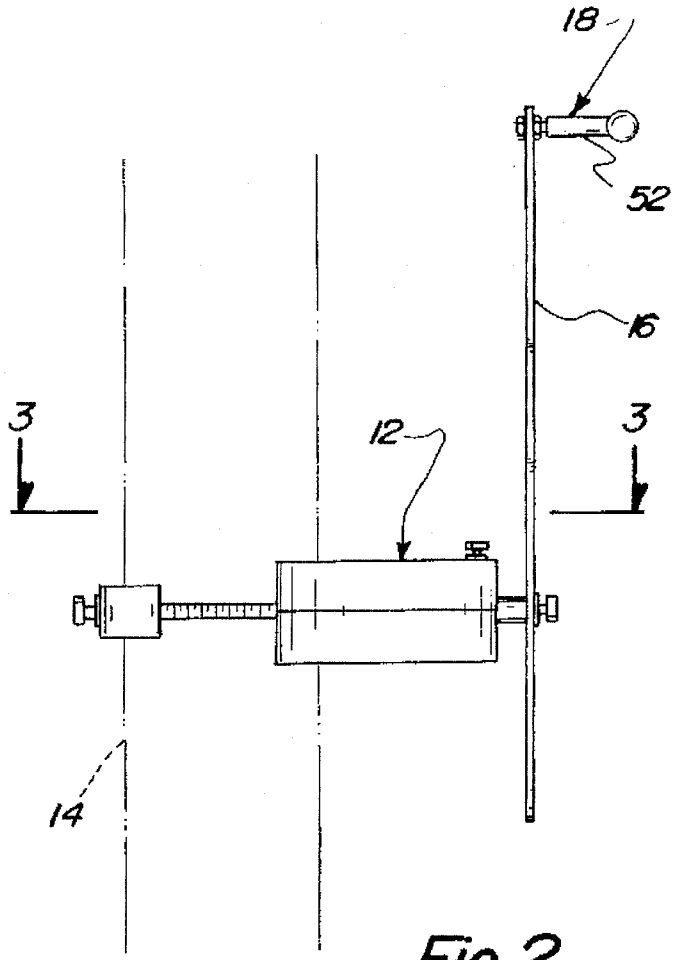
FIG. 2 is a side elevation view thereof.

With reference now to the drawings, and in particular to FIGS. 1–8 thereof, a new door frame mounted exerciser embodying the principles and concepts of the present invention and generally designated by the reference numeral 10 will be described.

More specifically, it will be noted that the door frame mounted exerciser 10 comprises a mounting means 12 for securing to a frame 14 of a door. A rotatable arm 16 is rotatably mounted to the mounting means 12 and frictionally retarded against movement relative thereto. A limb engaging means 18 is coupled to a distal end of the rotatable arm 16 and can be engaged and manipulated by an individual 20 to effect rotation of the rotatable arm 16 against the retarding frictional coupling between the rotatable arm and the mounting means to exercise the engaged limb 22.

As best illustrated in FIGS. 3 through 6, it can be shown that the mounting means 12 according to the present invention 10 preferably comprises a mounting block 24 having a first clamp leg 26 projecting therefrom. The first clamp leg 26 terminates in an engaging projection 28 so as to define an unlabeled door frame receiving cavity between the engaging projection 28 and the mounting block 24. A threaded rod 30 projects from the mounting block 24 and is directed through an unlabeled aperture of a second clamp leg 32 slidably positioned about the threaded rod. A securing nut 34 is threadably engaged to the threaded rod 30 so as to capture the second clamp leg 32 between the securing nut and the mounting block 24. By this structure, the first clamp leg 26 can be positioned into an abutting engagement with the door frame 14, with the second clamp leg 32 being advanced towards the mounting block 24 through a rotation of the securing nut 34 to engage and capture the door frame between the second clamp leg and the first clamp leg 26. The engaging projection 28 serves to preclude an unintentional disengagement of the mounting means 12 from the associated door frame 14.

To rotatably coupled the rotatable arm 16 to the mounting means 12 while simultaneously frictionally retarding motion of the rotatable arm relative to the mounting means 12, a support axle 36 having a guide projection 38 extending from a first end thereof is positioned within a receiving bore 40 formed in the first clamp leg 26. The support axle 36 extends from the first clamp leg 26 in a substantially parallel orientation relative to the mounting block 24 and is captured between a fixed clamp member 42 and a removable clamp member 44. The fixed clamp member 42 is integrally or otherwise fixedly secured to the mounting block 24, with the removable clamp member 44 being coupled to the fixed clamp member 42 by a pair of frictional fasteners 46 directed through the removable clamp member and threadably engaged to the fixed clamp member. The support axle 36, as shown in the cross sectional illustration of FIG. 4, extends through an unlabeled bore defined by opposed semi-circular bores extending through both the fixed clamp member 42 and the removable clamp member 44. By this structure, the frictional fasteners 46 can be rotatably advanced relative to the fixed clamp member 42 so as to clamp the support axle 36 within the bore extending between the clamp members. Thus, a tightening of the frictionally fasteners 46 will increase a rotational retarding force acting against rotation of the support axle 36 relative to the mounting means 12 created by a frictional engagement between the clamp members and an exterior of the support axle.

Figure 1:
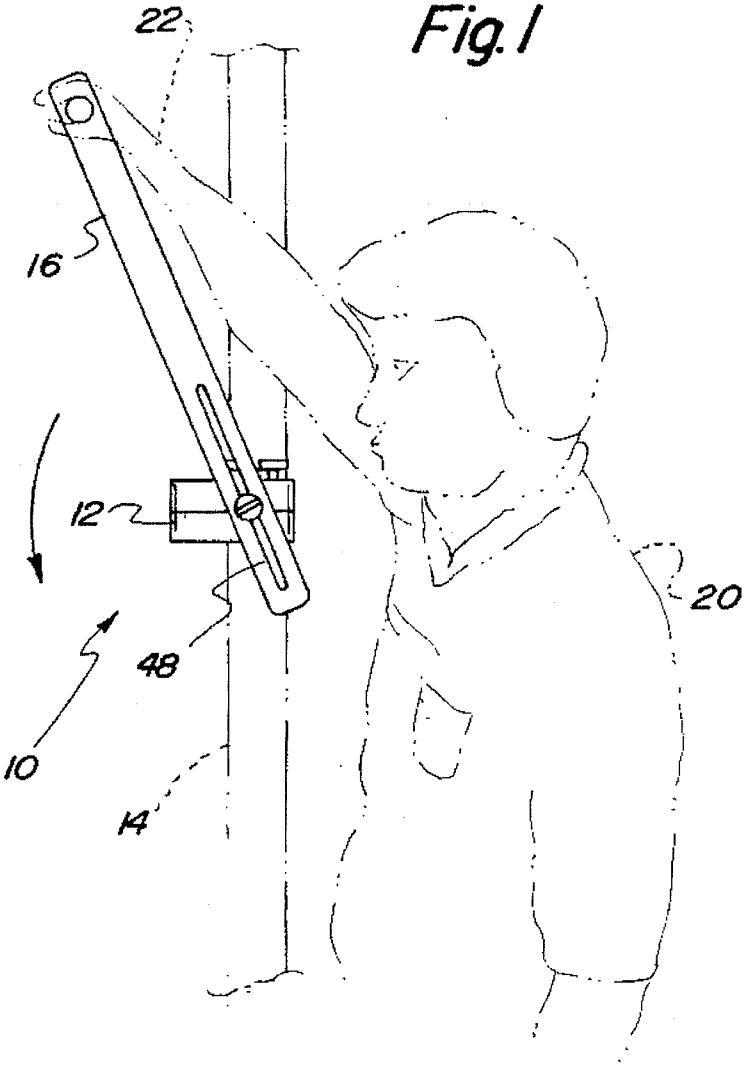
FIG. 1 is a front elevation view of a door frame mounted exerciser according to the present invention in use.
Figure 3:
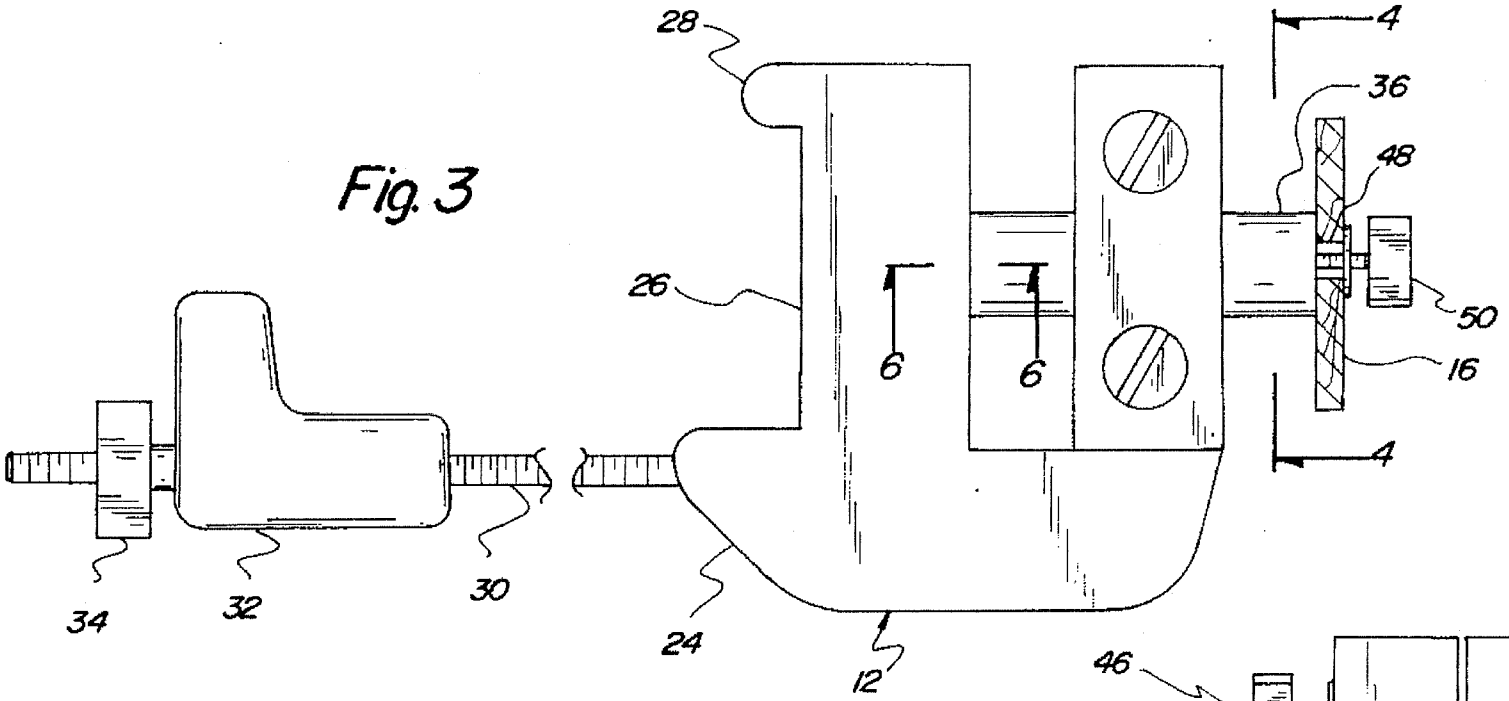
FIG. 3 is a cross sectional view taken along line 3—3 of FIG. 2.
Figure 4:
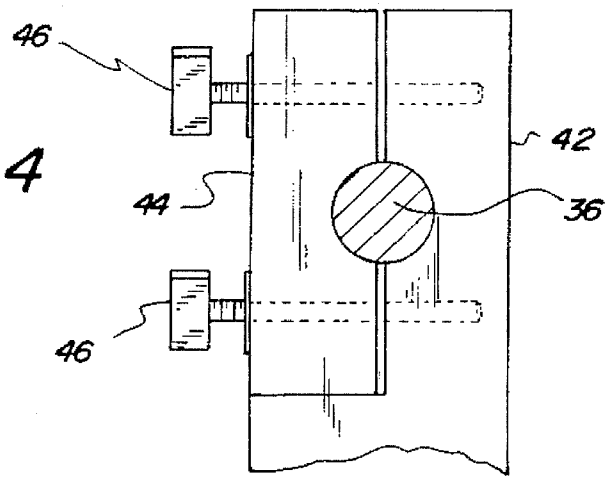
FIG. 4 is a further cross sectional view taken along line 4—4 of FIG. 3.
Figure 5:
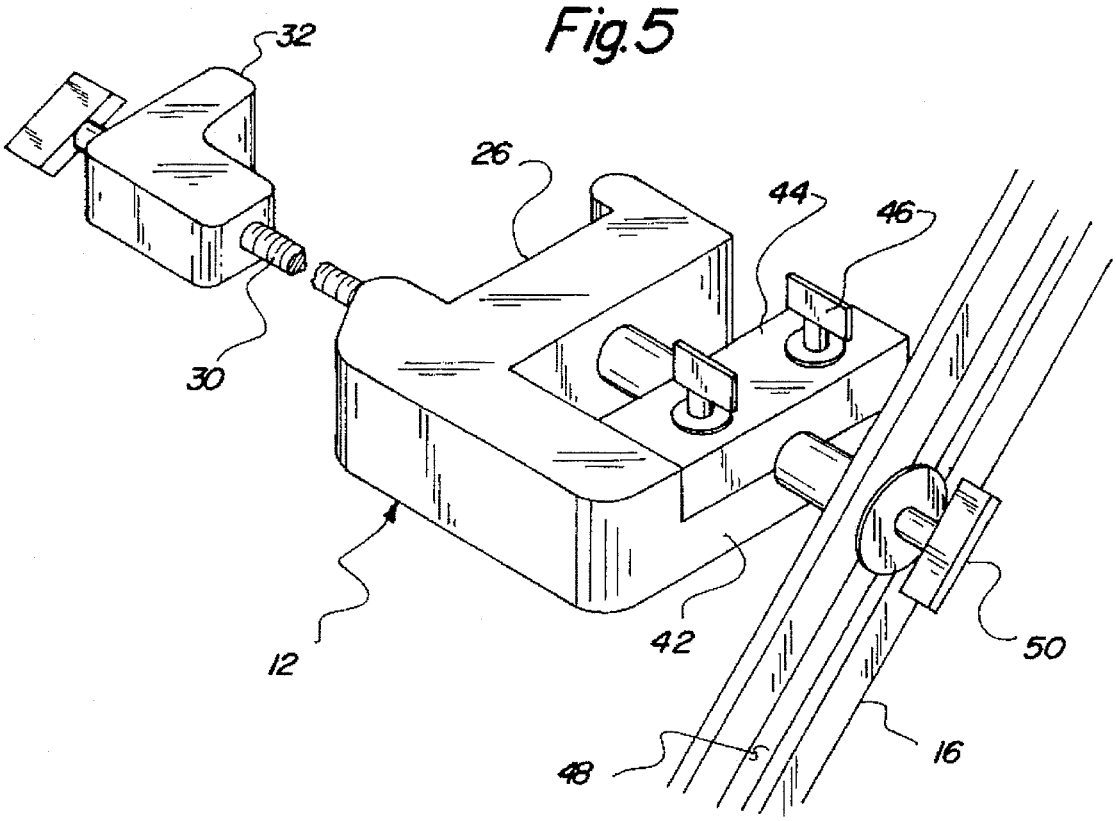
FIG. 5 is an isometric illustration of a mounting means comprising a portion of the present invention.
Figure 6:
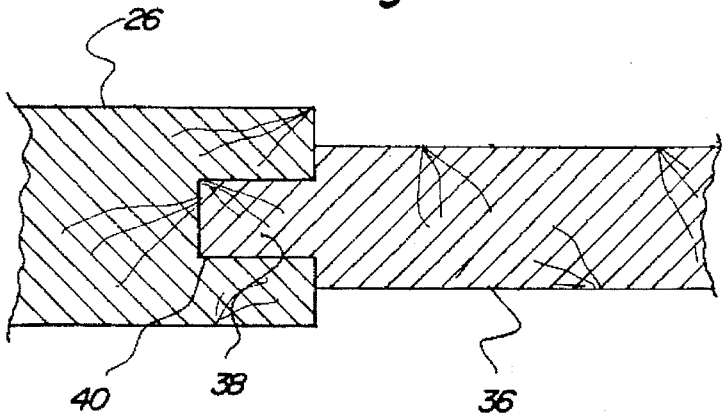
FIG. 6 is a cross sectional view taken along line 6—6 of FIG. 3.

As shown in the illustration of FIG. 1, the rotatable arm 16 is provided with an elongated slot 48 through which a securing fastener 50 (see FIG. 3) is directed to threadably engage a second end of the support axle 36. The securing fastener 50 can thus be loosened to permit a sliding positioning of the rotatable arm 16 into a desired orientation relative to the support axle 36, whereby a tightening of the securing fastener 50 will secure a position of the rotatable arm 16 relative to the support axle. By this structure, an effective lever arm length of the rotatable arm 16 can be established to either increase or decrease the amount of force needed at the limb engaging means 18 to cause a rotation of the rotatable arm relative to the mounting means 12 for a particular amount of frictional engagement between the clamp members 42, 44 and an exterior of the support axle 36.

Figure 7:
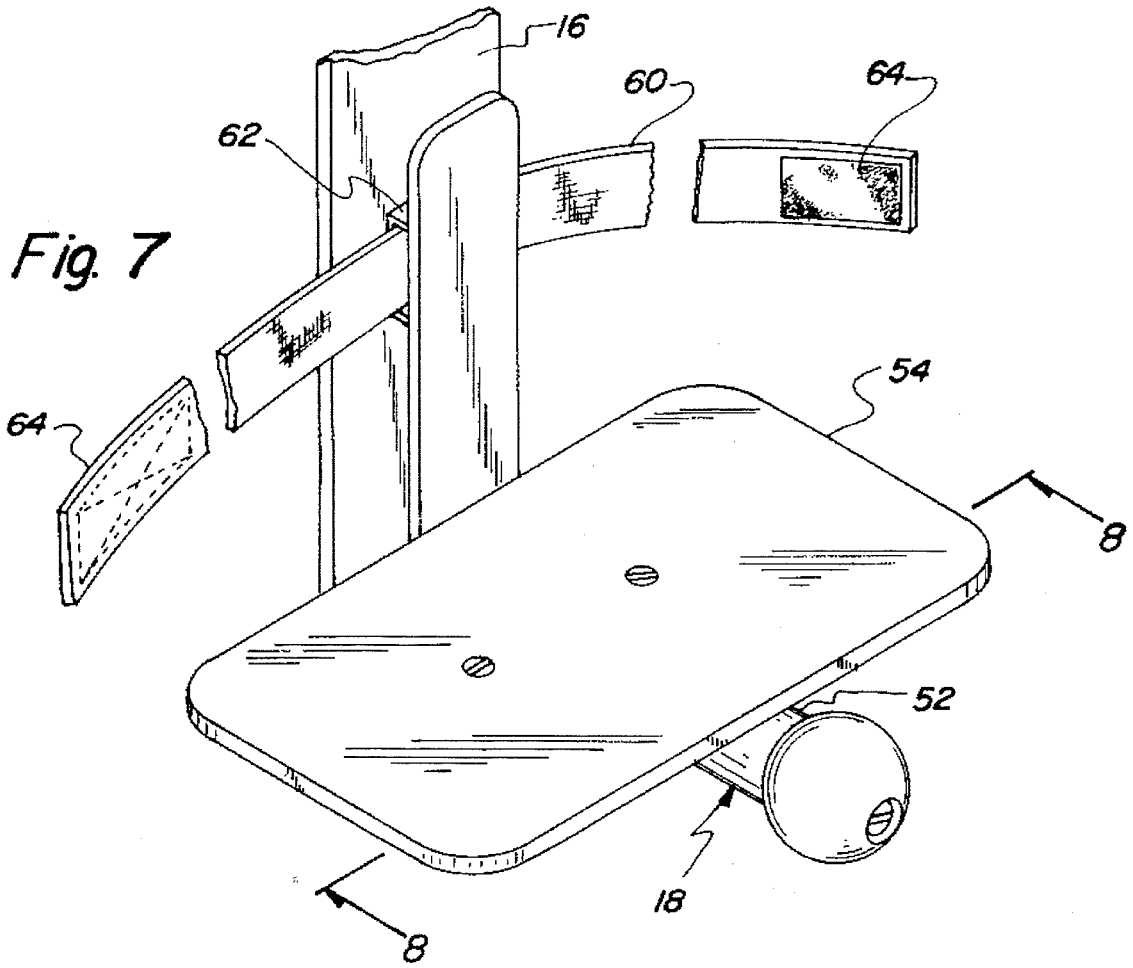
FIG. 7 is an isometric illustration of an alternative limb engaging means comprising a portion of the present invention.
Figure 8:
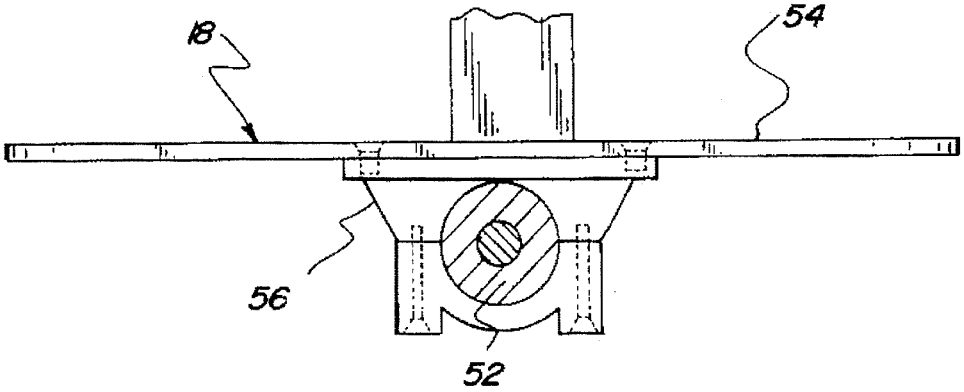
FIG. 8 is a cross sectional view taken along line 8—8 of FIG. 7.

As best illustrated in FIG. 2, the limb engaging means 18 according to the present invention 10 preferably comprises a substantially cylindrical handle tube 52 rotatably mounted to an outer distal end of the rotatable arm 16 by an unillustrated handle tube axle. The handle tube 52 is thus rotatable relative to the rotatable arm 16 and can be grasped and manipulated by an individual, as illustrated in FIG. 1, to effect rotation of the rotatable arm relative to the mounting means 12. As shown in FIGS. 7 and 8, the limb engaging means 18 may additionally comprise a foot plate 54 secured to the handle tube 52 by a mounting clamp 56. The alternative form of the limb engaging means 18 illustrated in FIGS. 7 and 8 preferably further includes an unlabeled lateral guide plate projecting from the foot plate 54 and substantially parallel to the rotatable arm 16. A securing strap 60 is slidably coupled to the lateral guide plate 58 by extending through a strap guide 62 coupled to the lateral guide plate and positioned between the rotatable arm 16 and the lateral guide plate. The securing strap 60 is provided with cooperating fabric fastening material 64 at opposite ends thereof which permit a securement of the securing straps 60 about an ankle or lower leg portion of an individual. By this structure, the mounting means 12 of the present invention 10 can be positioned towards a lower portion of the door frame 14, whereby an individual standing or preferably sitting within a chair can position a foot upon the foot plate 54, secure the lower leg through a positioning of the securing strap 60 thereabout, and effect movement of the rotatable arm 16 against the frictional engagement between the rotatable arm and the mounting means 12 to effect exercising of the lower limb.

In use, the door frame mounted exerciser 10 according to the present invention can be easily installed to a door frame 14 of any particular width. The device 10 can be conveniently deconstructed into its component parts to facilitate carrying and/or storing thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What ms claimed as being new and desired to be protected by Letters Patent of the United States is as follows:

1. A door frame mounted exerciser comprising:

a mounting means for securing to a frame;

a rotatable arm rotatably mounted at a proximal end thereof to the mounting means;

and, a limb engaging means coupled to a distal end of the rotatable arm for being engaged and manipulated by an individual to effect rotation of the rotatable arm to exercise an engaged limb;

wherein the mounting means comprises a mounting block having a receiving bore and a first clamp leg projecting therefrom; a threaded rod projecting from the mounting block; a second clamp leg slidably positioned about the threaded rod; a securing nut threadably engaged to the threaded rod so as to capture the second clamp leg between the securing nut and the mounting block; a support axle coupled to the rotatable arm and having a guide projection extending from a first end thereof positioned within a receiving bore directed into the first clamp leg; a fixed clamp member fixedly secured to the mounting block; a removable clamp member coupled to the fixed clamp member by a pair of frictional fasteners directed through the removable clamp member and threadably engaged to the fixed clamp member, the removable clamp member and the fixed clamp member each having semi-circular bores extending therethrough which cooperate to define a bore through which the axle projects, whereby the frictional fasteners can be rotatably advanced relative to the fixed clamp member so as to clamp the support axle within the bore extending between the clamp members.

2. The door frame mounted exerciser of claim 1, wherein the rotatable arm is shaped so as to define an elongated slot; and further comprising a securing fastener directed through the elongated slot and threadably engaged to a second end of the support axle.

3. The door frame mounted exerciser of claim 2, wherein the limb engaging means comprises a substantially cylindrical handle tube rotatably mounted to the distal end of the rotatable arm.

4. The door frame mounted exerciser of claim 3, wherein the limb engaging means further comprises a foot plate secured to the handle tube.

5. The door frame mounted exerciser of claim 4, wherein the limb engaging means further comprises a lateral guide plate projecting from the foot plate and substantially parallel to the rotatable arm; and a securing strap slidably coupled to the lateral guide plate for securing about a limb of an individual.

6. The door frame mounted exerciser of claim 5, wherein the first clamp leg of the mounting means terminates in an engaging projection so as to define a door frame receiving cavity between the engaging projection and the mounting block.

* * * * *